US010845736B2

(12) United States Patent
Sato et al.

(10) Patent No.: US 10,845,736 B2
(45) Date of Patent: Nov. 24, 2020

(54) BELT UNIT AND IMAGE FORMING APPARATUS

(71) Applicant: Oki Data Corporation, Tokyo (JP)

(72) Inventors: Yoshitomo Sato, Tokyo (JP); Masanori Minato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/686,440

(22) Filed: Nov. 18, 2019

(65) Prior Publication Data

US 2020/0241445 A1 Jul. 30, 2020

(30) Foreign Application Priority Data

Jan. 25, 2019 (JP) ..... 2019-011050

(51) Int. Cl.
*G03G 21/10* (2006.01)
*G03G 15/16* (2006.01)
*G03G 15/095* (2006.01)

(52) U.S. Cl.
CPC ..... *G03G 15/161* (2013.01); *G03G 21/105* (2013.01); *G03G 15/095* (2013.01)

(58) Field of Classification Search
CPC ..... G03G 15/161; G03G 15/168; G03G 21/0005; G03G 21/007; G03G 21/10; G03G 21/0011; G03G 21/12; G03G 21/0035; G03G 21/0076; G03G 21/105; G03G 2215/1647; G03G 2215/1661; G03G 2221/001; G03G 2221/0005; G03G 2221/0047; G03G 2221/0052; G03G 2221/0068; G03G 2221/0089; G03G 2221/1618; G03G 2221/1621
See application file for complete search history.

(56) References Cited

U.S. PATENT DOCUMENTS

2006/0034632 A1* 2/2006 Takada ..... G03G 21/0011 399/101

FOREIGN PATENT DOCUMENTS

JP 2018-124537 A 8/2018

* cited by examiner

*Primary Examiner* — Thomas S Giampaolo, II
(74) *Attorney, Agent, or Firm* — Muncy, Geissler, Olds & Lowe, P.C.

(57) ABSTRACT

A belt unit includes a belt member, a cleaning member that scrapes off a developer being attached and carried on the belt member, a waste developer accommodation chamber that accommodates the developer as a waste developer, a waste developer carrying member that carries the waste developer accommodated in the waste developer accommodation chamber in correspondence with a rotation thereof; and a waste developer taking-up member that takes up the waste developer in correspondence with a rotation thereof and supplies the waste developer to a contact portion between the cleaning member and the belt member, wherein the waste developer taking-up member is composed with a shaft and a brush attached to the shaft.

13 Claims, 12 Drawing Sheets

BELT UNIT AND IMAGE FORMING APPARATUS

TECHNICAL FIELD

The present invention relates to a belt unit and an image forming apparatus.

BACKGROUND

Conventionally, in an image forming apparatus such as a printer, a copying machine, a facsimile, or a multifunction machine, for example, in an electrophotographic color printer, black, yellow, magenta and cyan image forming units are arranged, and in each of the image forming units, a surface of a photosensitive drum is uniformly charged by a charging roller and is exposed by an LED head in which LED elements are arranged in a line to form an electrostatic latent image, and a toner on a development roller is adhered to the electrostatic latent image to form a toner image.

Then, in a printer of an intermediate transfer type, in a transfer unit, the toner images of the respective colors are super-imposingly transferred to an intermediate transfer belt as a belt member by transfer rollers to form a color toner image, and the color toner image is transferred to a sheet and is fused onto the sheet in a fuser.

However, in the printer, a cleaning device is arranged in order to remove a toner as a developer remaining on the intermediate transfer belt after the color toner image on the intermediate transfer belt has been transferred to the sheet. In the cleaning device, a cleaning blade is arranged to be in contact with the intermediate transfer belt and the toner is scraped off by the cleaning blade.

The scraped toner falls down as a waste toner as a waste developer to a scraped toner accommodation part as a waste developer accommodation chamber arranged below the cleaning blade, and is carried by a spiral arranged in the scraped toner accommodation part and is sent to a waste toner box.

However, when an amount of the toner remaining on the intermediate transfer belt is small, friction between the cleaning blade and the intermediate transfer belt increases, and curling, chipping, or the like occurs to a tip of the cleaning blade. As a result, the toner remaining on the intermediate transfer belt cannot be sufficiently removed.

Therefore, in the printer, a brush is attached to the spiral, and, as the spiral rotates, the waste toner is taken up by the brush and the waste toner is supplied as a lubricant to a contact portion between the cleaning blade and the intermediate transfer belt, and thereby, an increase in the friction between the cleaning blade and the intermediate transfer belt is suppressed and occurrence of curling, chipping or the like to the cleaning blade is prevented, and the toner remaining on the intermediate transfer belt is removed more than ordinary mechanism (for example, see Patent Document 1).

RELATED ART

[Patent Doc. 1] JP Laid-Open Patent Application Publication 2018-124537

However, in the above-described conventional printer, when the brush attached to the spiral comes into contact with a bottom wall of the scraped toner accommodation part, the ability of the spiral to carry the waste toner is lowered, and, as a result, when the spiral causes clogging, the waste toner in the scraped toner accommodation part cannot be reliably carried.

The present invention is intended to solve the above-described problem of the conventional printer, and to provide a belt unit and an image forming apparatus that allow a developer remaining on a belt member to be sufficiently removed and allow a waste developer in a waste developer accommodation chamber to be reliably carried.

SUMMARY

A belt unit, disclosed in the application, includes (a) a belt member that is stretched by a plurality of rollers in a manner freely travelable; (b) a cleaning member that is arranged with a tip thereof being in contact with the belt member and scrapes off a developer being attached and carried on the belt member as the belt member travels; (c) a waste developer accommodation chamber that accommodates the developer as a waste developer scraped off by the cleaning member; (d) a waste developer carrying member that is rotatably arranged in the waste developer accommodation chamber and carries the waste developer accommodated in the waste developer accommodation chamber in correspondence with a rotation thereof; and (e) a waste developer taking-up member that is rotatably arranged adjacent to the waste developer carrying member in the waste developer accommodation chamber, and takes up the waste developer in correspondence with a rotation thereof and supplies the waste developer to a contact portion between the cleaning member and the belt member.

The waste developer taking-up member is composed with a shaft and a brush attached to the shaft.

In this case, the waste developer 'member having the shaft and the brush is rotatably arranged adjacent to the waste developer carrying member in the waste developer accommodation chamber, and the waste developer is taken up along with the rotation of the waste developer taking-up member and is supplied as a lubricant to the contact portion between the cleaning member and the belt member.

Therefore, an increase in the friction between the cleaning member and the belt member can be suppressed and occurrence of curling, chipping or the like to the tip of the cleaning member can be prevented.

Therefore, the developer remaining on the belt member can be sufficiently removed.

Further, since the waste developer carrying member is arranged independently of the waste developer taking-up member, even when the brush comes into contact with the bottom wall of the waste developer accommodation chamber, the ability of the waste developer carrying member to carry the waste developer is not lowered. Therefore, the waste developer carrying member does not cause clogging, and thus, the waste developer can be reliably carried.

DETAILED DESCRIPTIONS OF PREFERRED EMBODIMENT(S)

In the following, embodiments of the present invention are described in detail with reference to the drawings. In this case, a belt unit and a printer as an image forming apparatus are described.

Figure 2:
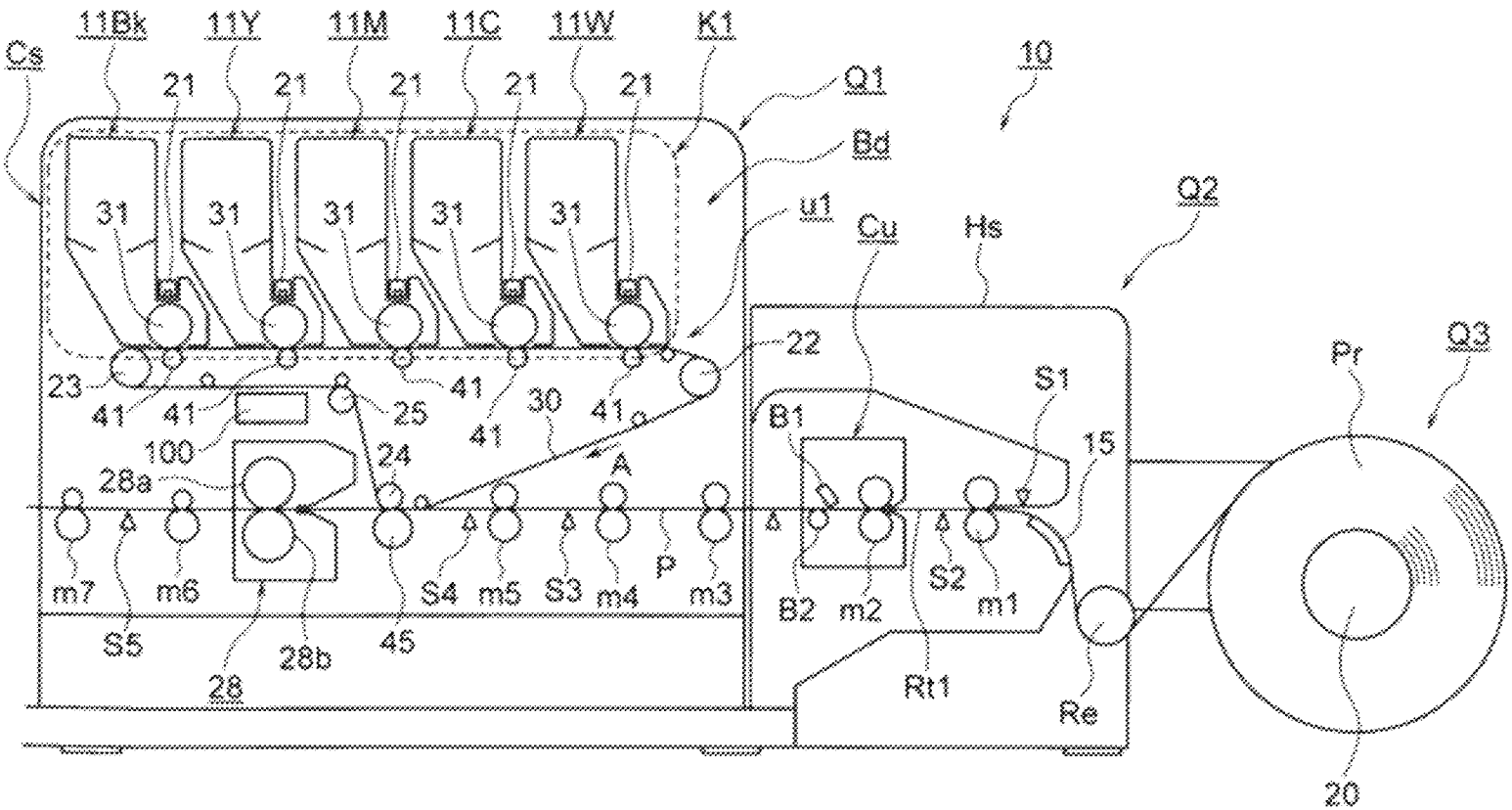
FIG. 2 is a conceptual diagram of a printer in the first embodiment of the present invention.
Figure 3:
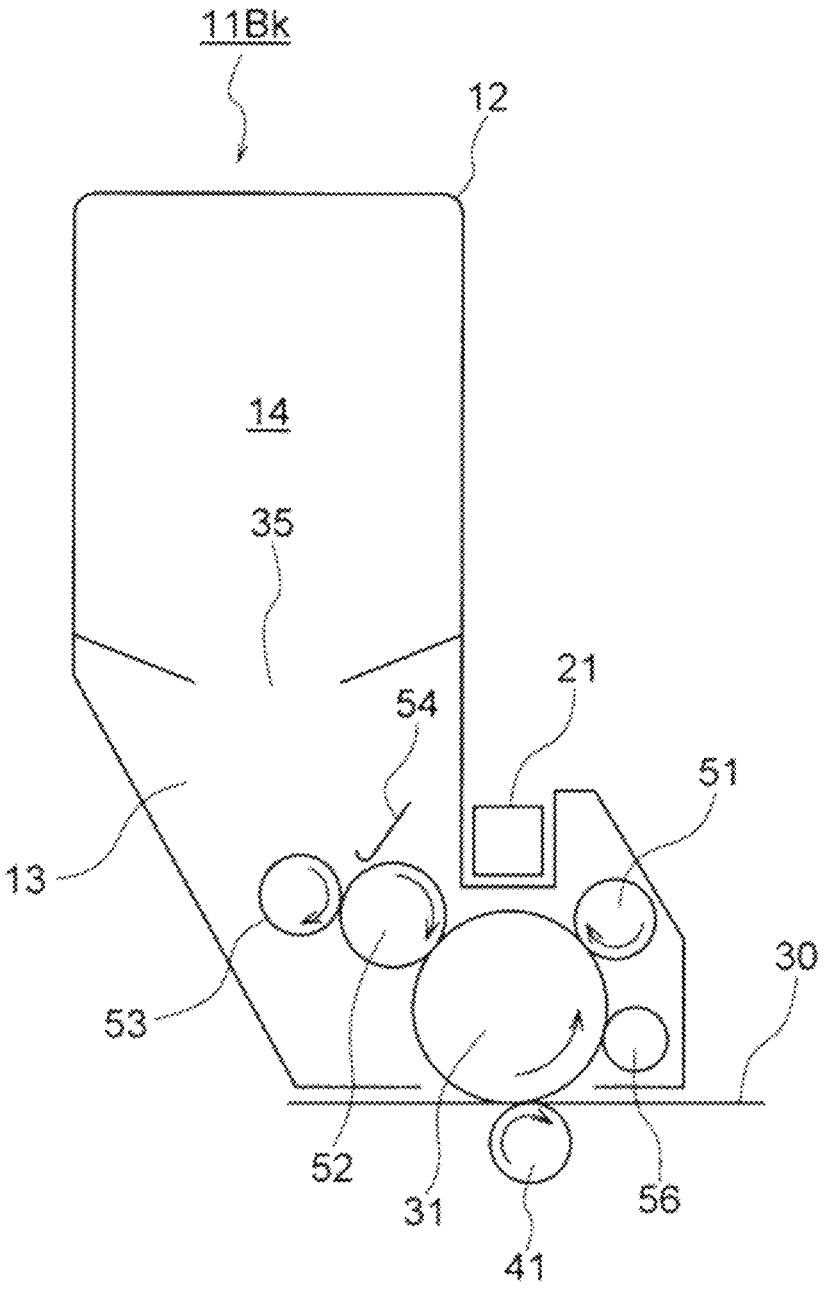
FIG. 3 is a cross-sectional view of an image forming unit in the first embodiment of the present invention.

FIG. 2 is a conceptual diagram of a printer in a first embodiment of the present invention. FIG. 3 is a cross-sectional view of an image forming unit in the first embodiment of the present invention.

In FIG. 2, "10" denotes a printer. The printer 10 includes: a main body part Q1; a feeder unit Q2 that is arranged so as to protrude from the main body part Q1 to a lateral side and carries a long sheet P as a medium; and a sheet feeding device Q3 that feeds the sheet P. A sheet carrying path Rt1 as a medium carrying path for carrying the sheet P from the feeder unit Q2 to the main body part Q1 is formed extending in a horizontal direction.

Further, in the sheet feeding device Q3, "20" denotes a feeding device; and "Pr" denotes a roll sheet set on the feeding device 20.

In the feeder unit Q2, "Hs" denotes a housing; "Re" denotes a tension roller as a tension application member applying a tension to the sheet P fed out from the feeding device 20; and "15" denotes a guide guiding the sheet P to the sheet carrying path Rt1.

The feeder unit Q2 includes, from an upstream side to a downstream side in the sheet carrying path Rt1, an inlet sensor S1 arranged adjacent to the guide 15, a carrying roller pair m1, a sheet feeding sensor S2, a cutter unit Cu, and the like. The cutter unit Cu includes a carrying roller pair m2, a fixed blade B1 and a rotary blade B2, and cuts the sheet P at a predetermined place by rotating the rotary blade B2 relative to the fixed blade B1.

In the main body part Q1, "Cs" denotes a casing; "K1" denotes an image forming part arranged on an upper side inside the casing Cs; and "u1" denotes a transfer unit as a belt unit arranged below in the image forming part K1 inside the casing Cs.

Below the transfer unit u1, the sheet carrying path Rt1 extends through the casing Cs, and from an upstream side to a downstream side along the sheet carrying path Rt1, carrying roller pairs m3, m4, a position sensor S3, a carrying roller pair m5, a position sensor S4, a secondary transfer roller 45 as a transfer member for secondary transfer (to be described later), a fuser 28 as a fuser device (to be described later), a carrying roller pair m6, an ejection sensor S5, an ejection roller pair m7, and the like are arranged.

The carrying roller pairs m1-m6 and the ejection roller pair m7 are rotated by driving a carrying motor (not illustrated in the drawings) as a drive part for carrying, and carry the sheet P.

The image forming part K1 includes black, yellow, magenta, cyan and white image forming units 11Bk, 11Y, 11M, 11C, 11W that are detachably arranged with respect to an apparatus main body Bd, and includes LED heads 21 as exposure devices that are respectively arranged opposing photosensitive drums 31 as image carriers of the image forming units 11Bk, 11Y, 11M, 11C, 11W at positions above the photosensitive drums 31.

The transfer unit u1 includes: rollers such as a driving roller 22, a driven roller 23, a tension roller 24, and a bending roller 25; an intermediate transfer belt 30 as a belt member stretched by the rollers in a manner freely travelable in an arrow A direction; primary transfer rollers 41 as transfer members for primary transfer respectively arranged opposing the photosensitive drums 31 via the intermediate transfer belt 30; the secondary transfer roller 45 arranged opposing the tension roller 24 via the intermediate transfer belt 30; a cleaning device 100 arranged in contact with the intermediate transfer belt 30 on a downstream side of the bending roller 25 in the traveling direction of the intermediate transfer belt 30; and the like. A primary transfer part is formed between the photosensitive drums 31 and the primary transfer rollers 41; and a secondary transfer part is formed between the tension roller 24 and the secondary transfer roller 45.

Further, the fuser 28 includes a heat application roller 28*a* as a first fuser member, a pressure application roller 28*b* as a second fuser member, and the like.

Next, the image forming units 11Bk, 11Y, 11M, 11C, 11W are described. Since the image forming units 11Bk, 11Y, 11M, 11C, 11W have the same structure, in this case, the image forming unit 11Bk is described.

In FIG. 3, "11Bk" denotes an image forming unit; "12" denotes a unit case of the image forming unit 11Bk; "13" denotes a toner storage chamber as a developer storage chamber formed in the unit case 12; and "14" denotes a toner accommodation chamber as a developer accommodation chamber that is formed above the toner storage chamber 13 in the unit case 12 and is for accommodating a toner as a developer.

The toner accommodation chamber 14 and the toner storage chamber 13 are communicatively connected via a toner supply port 35 as a developer supply port, and a toner supplied from the toner accommodation chamber 14 to the toner storage chamber 13 is stored in the toner storage chamber 13 as a stirring member (not illustrated in the drawings) is rotated.

Further, "31" denotes the photosensitive drum that is arranged in a manner rotatable in an arrow direction; "51" denotes a charging roller as a charging device that is arranged to be in contact with the photosensitive drum 31 in a manner rotatable in an arrow direction and uniformly charges a surface of the photosensitive drum 31; "52" denotes a development roller as a developer carrier that is arranged to be in contact with the photosensitive drum 31 in a manner rotatable in an arrow direction and forms a toner image by performing development by attaching a toner as a developer to an electrostatic latent image as a latent image formed on the surface of the photosensitive drum 31; "53" denotes a toner supply roller as a developer supply member that is arranged in the toner storage chamber 13 to be in contact the development roller 52 in a manner rotatable in an arrow direction and supplies the toner to the development roller 52; "54" denotes a development blade as a developer regulating member that is arranged such that a predetermined portion near a tip thereof is in contact with the development roller 52, and that causes the toner on the development roller 52 to be formed into a thin layer; and "56" denotes a cleaning roller as a cleaning member for removing a residual toner which is a toner remaining on the photosensitive drum 31 after the toner image has been transferred to the intermediate transfer belt 30 (FIG. 2). Further, "21" denotes the LED head; and "41" denotes the primary transfer roller.

Next, an operation of the printer 10 having the above-described configuration is described.

In the sheet feeding device Q3, the sheet P fed out from the feeding device 20 is fed to the feeder unit Q2. In the feeder unit Q2, the sheet P is tensioned by the tension roller Re, and then, is carried by the carrying roller pairs m1, m2, and is cut by the cutter unit Cu, and is fed to the main body part Q1.

The sheet P fed to the main body part Q1 is carried by the carrying roller pairs m3-m5 and is fed to the secondary transfer part between the tension roller 24 and the secondary transfer roller 45 and is carried between the tension roller 24 in the transfer unit u1 and the secondary transfer roller 45.

On the other hand, in the image forming units 11Bk, 11Y, 11M, 11C, 11W, the surfaces of the photosensitive drums 31 are respectively uniformly charged by the charging rollers 51 and exposed by the LED heads 21, and electrostatic latent images are respectively formed on the photosensitive drums 31.

Further, the toners respectively supplied from the toner accommodation chambers 14 to the toner storage chambers 13 and stored in the toner storage chambers 13 are respectively supplied by the toner supply rollers 53 to the development rollers 52, and electrostatically attached to the electrostatic latent images on the photosensitive drums 13, and toner images of the respective colors are formed.

Then, when the driving roller 22 is rotated, the intermediate transfer belt 30 is caused to travel in the arrow A direction. In the primary transfer part between the photosensitive drums 31 and the primary transfer rollers 41, the toner images of the respective colors are sequentially superimposingly transferred to a surface of the intermediate transfer belt 30 by the primary transfer rollers 41, and a color toner image is formed on the surface of the intermediate transfer belt 30. When the color toner image on the intermediate transfer belt 30 reaches the secondary transfer part, the color roller image is transferred to the sheet P by the transfer roller 45.

Subsequently, the sheet P onto which the color toner image has been transferred is fed to the fuser 28. In the fuser 28, the color toner image on the sheet P is heated by the heat application roller 28*a*, and is pressed by the pressure application roller 28*b*, and is fused on the sheet P, and a color image is formed on the sheet P.

The sheet P on which the color image has been formed is carried by the carrying roller pair m6 and is ejected to outside of the apparatus main body Bd by the ejection roller pair m7, and is stacked on a stacker (not illustrated in the drawings) arranged outside of the apparatus main body Bd.

In the image forming units 11Bk, 11Y, 11M, 11C, 11W, after the toner images on the photosensitive drums 31 have been transferred to the intermediate transfer belt 30, residual toners remaining on the photosensitive drums 31 are scraped off by the cleaning rollers 56, and the waste toners as waste developers are respectively sent to waste toner accommodation chambers (not illustrated in the drawings) that are respectively formed in the unit cases 12.

Further, in the secondary transfer part, after the color toner image on the intermediate transfer belt 30 has been transferred to the sheet P, a toner remaining on the intermediate transfer belt 30, that is, a transfer residual toner as a transfer residual developer is removed by the cleaning device 100.

Next, the transfer unit u1 is described.

Figure 1:
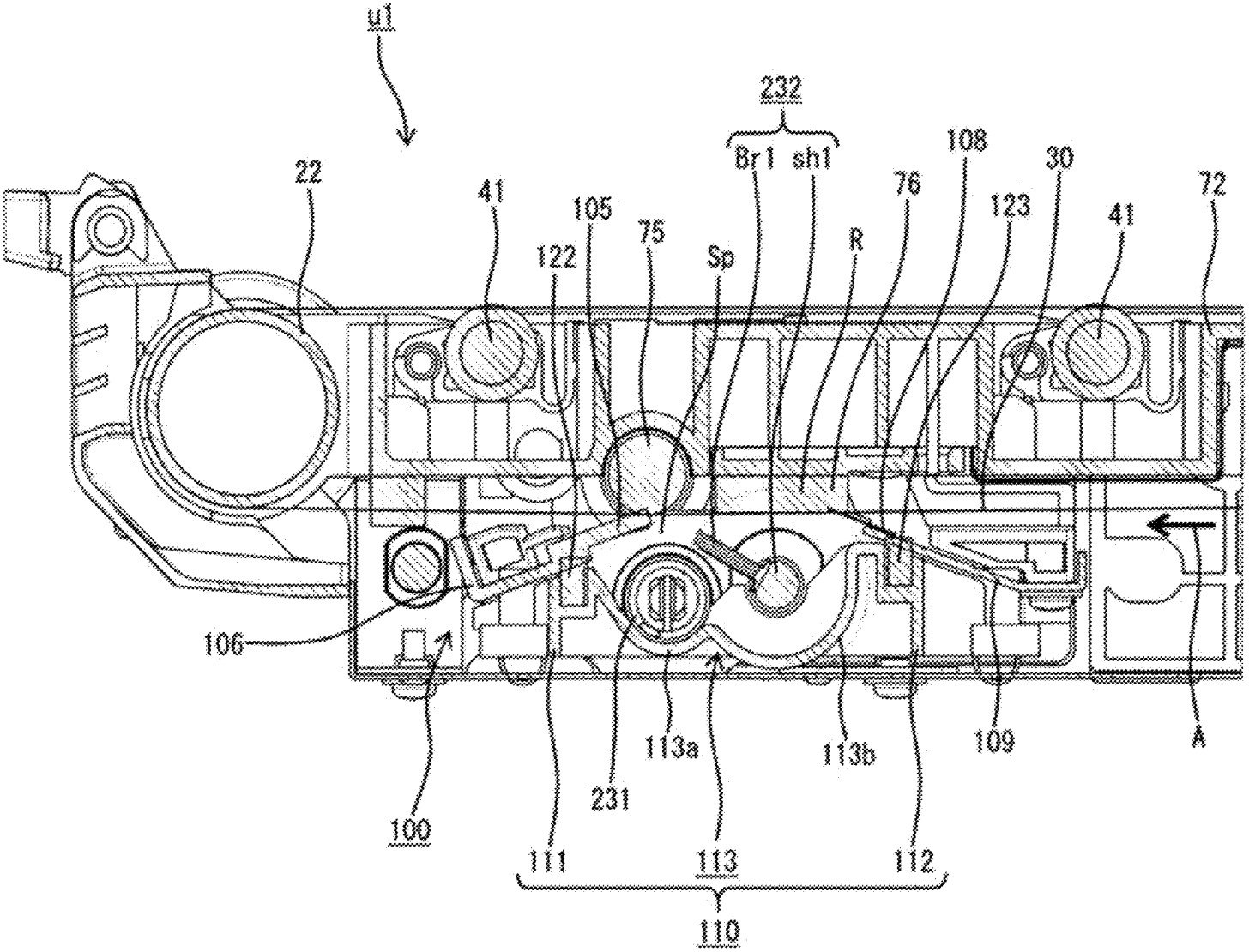
FIG. 1 is a cross-sectional view of a main part of a transfer unit in a first embodiment of the present invention.
Figure 4:
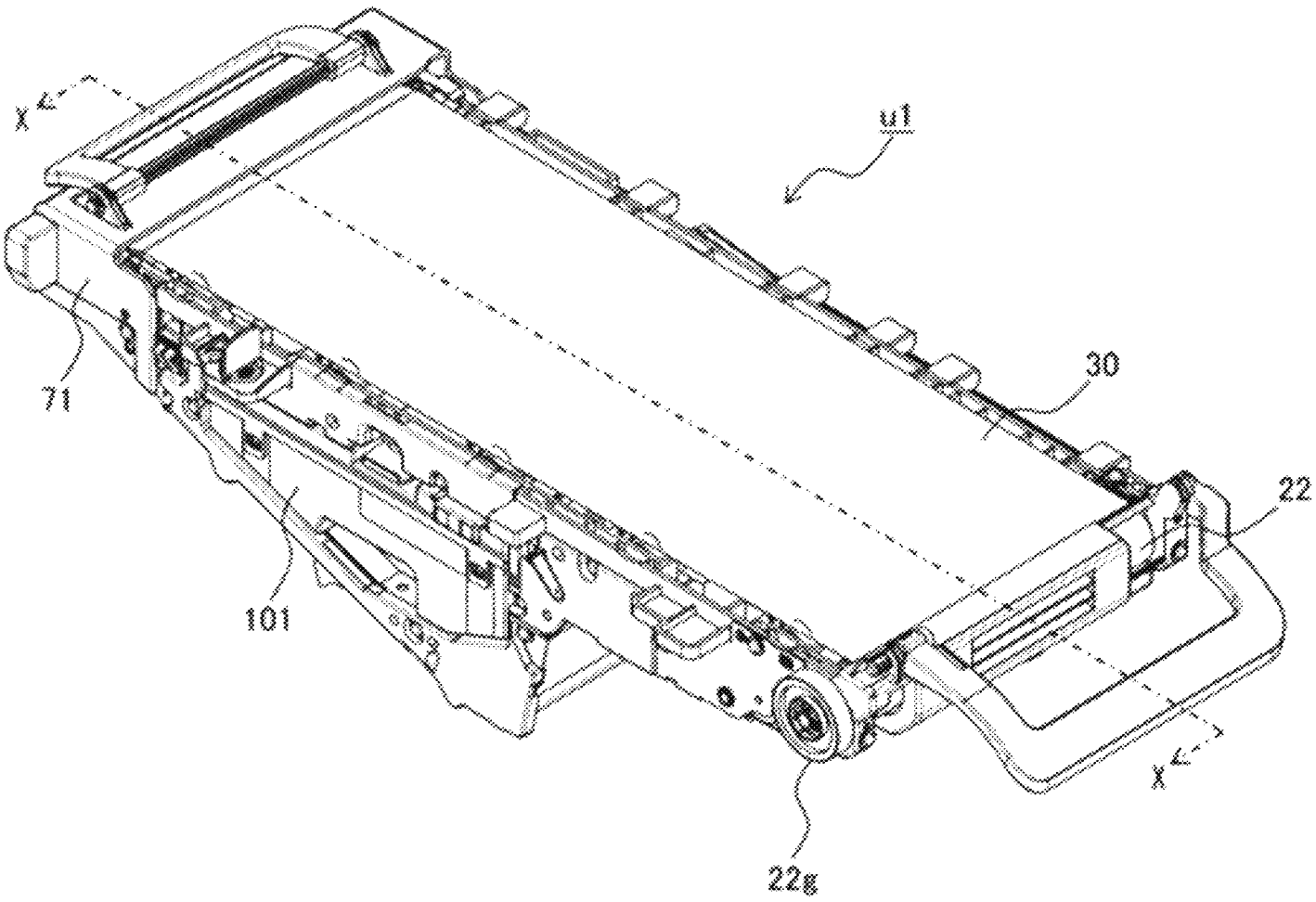
FIG. 4 is a perspective view of the transfer unit in the first embodiment of the present invention.
Figure 5:
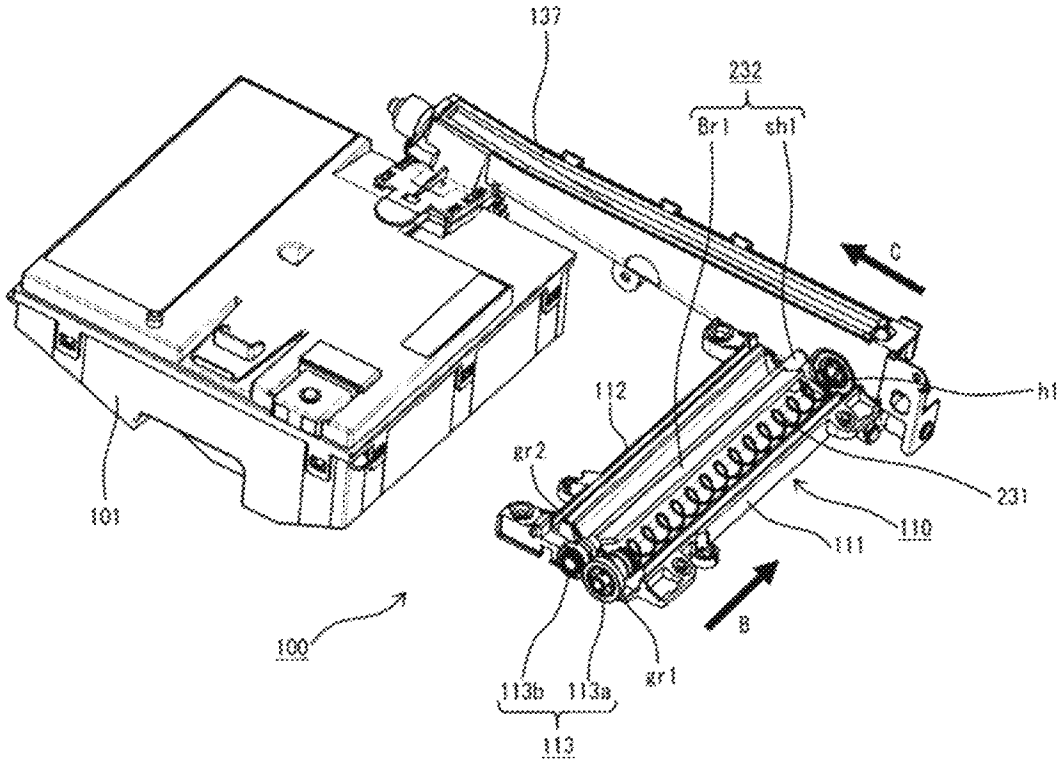
FIG. 5 is a perspective view illustrating a cleaning device and a waste toner box in the first embodiment of the present invention.

FIG. 1 is a cross-sectional view of a main part of the transfer unit in the first embodiment of the present invention. FIG. 4 is a perspective view of the transfer unit in the first embodiment of the present invention. FIG. 5 is a perspective view illustrating the cleaning device and a waste toner box in the first embodiment of the present invention. FIG. 1 is a cross-sectional view along a line X-X of FIG. 4.

In the drawings, "u1" denotes the transfer unit; "22" denotes the driving roller; "22*g*" denotes a gear for transmitting rotation to the driving roller 22; "30" denotes the intermediate transfer belt; "41" denotes the primary transfer rollers; "71" denotes a housing of the transfer unit u1; "72" denotes a support frame that is formed in the housing 71 and rotatably supports the primary transfer rollers 41; "100" denotes the cleaning device; "101" denotes a waste toner box as a waste developer recovery part that collects the toner removed by the cleaning device 100 as a waste toner.

The cleaning device 100 includes: a cleaning blade 105 as a cleaning member that is arranged with a tip thereof in contact with the intermediate transfer belt 30 and scrapes off the transfer residual toner on the intermediate transfer belt 30; a support roller 75 as a first support member that is rotatably arranged on a back side (upper surface) of a portion of the intermediate transfer belt 30 in contact with the tip of the cleaning blade 105 and supports the intermediate transfer belt 30; a thin film seal member 108 as a sealing member that is arranged with a tip thereof opposing the tip of the cleaning blade 105 and in contact with the intermediate transfer belt 30; a support sponge 76 as a second support member that is arranged on a back side (upper surface) of a portion of the intermediate transfer belt 30 in contact with the tip of the thin film seal member 108 and supports the intermediate transfer belt 30; a scraped toner accommodation part 110 as a waste developer accommodation chamber that is formed below the tips of the cleaning blade 105 and the thin film seal member 108 and accommodates the waste toner scraped off by the cleaning blade 105; and the like.

The support roller 75 applies a predetermined reaction force to the intermediate transfer belt 30 on the back side of the intermediate transfer belt 30 such that the intermediate transfer belt 30 is not deformed when pressed by the cleaning blade 105. Further, the support sponge 76 applies a predetermined reaction force to the intermediate transfer belt 30 on the back side of the intermediate transfer belt 30 such that the intermediate transfer belt 30 is not deformed when pressed by the thin film seal member 108 and a brush Br1 (to be described later).

The cleaning blade 105 scrapes off the transfer residual toner on the intermediate transfer belt 30 as the intermediate transfer belt 30 is caused to travel in the arrow A direction. In this case, the support roller 75 is caused to rotate on the back side of the intermediate transfer belt 30 and applies a predetermined reaction force to the cleaning blade 105 such that the intermediate transfer belt 30 is pressed by the cleaning blade 105 and does not bend.

Further, the thin film seal member 108 is slid with the intermediate transfer belt 30 as the intermediate transfer belt 30 is caused to travel in the arrow A direction.

In the scraped toner accommodation part 110, a spiral 231 as a waste developer carrying member formed of a coil spring and a waste toner taking-up unit 232 as a waste developer taking-up member are respectively arranged below the tip of the cleaning blade 105 and below the tip of the thin film seal member 108 in a manner parallel to each other and rotatable independently of each other.

As illustrated in FIG. 5, the spiral 231 is connected at one end to a gear gr1 as a first rotation transmission member arranged on an outer side of the scraped toner accommodation part 110, and is further connected via the gear gr1 to a waste toner carrying motor (not illustrated in the drawings) as a waste toner carrying drive part. Further, the waste toner taking-up unit 232 is connected at one end to a gear gr2 as a second rotation transmission member arranged on an outer side of the scraped toner accommodation part 110, and the gear gr2 and the gear gr1 are engaged with each other.

Therefore, when the waste toner carrying motor is driven, the spiral 231 is rotated, and waste toner that has been scraped off by the cleaning blade 105 and has fallen down to and has been accumulated in the scraped toner accommodation part 110 can be carried in an arrow B direction. Further, along with the rotation of the spiral 231, the waste toner taking-up unit 232 is synchronously rotated, and the waste toner in the scraped toner accommodation part 110 is taken up and is supplied as a lubricant to a contact portion (contact part) between the cleaning blade 105 and the intermediate transfer belt 30.

The waste toner carried in the arrow B direction in the scraped toner accommodation part 110 is supplied to a duct 137 as a waste developer carrying path formed in communication with the scraped toner accommodation part 110 at the other end side of the spiral 231, and is carried in an arrow C direction in the duct 137, and then, is supplied to the waste toner box 101. Therefore, an opening h1 for supplying the waste toner carried in the scraped toner accommodation part 110 to the duct 137 is formed in the duct 137, and a spiral (not illustrated in the drawings) as a waste developer carrying member for supplying the waste toner supplied via the opening h1 to the waste toner box 101 is rotatably provided in the duct 137.

Further, the scraped toner accommodation part 110 is formed of a box-like body having an opened upper part and extending in a width direction of the intermediate transfer belt 30, and includes a side wall 111 as a first wall formed rising up on a downstream side in the traveling direction of the intermediate transfer belt 30, a side wall 112 as a second wall formed rising up on an upstream side in the traveling direction of the intermediate transfer belt 30, and a bottom wall 113 as a third wall formed connecting the side walls 111, 112 and curving downward in a "W" shape. The bottom wall 113 includes a wall part 113*a* surrounding a lower half part of the spiral 231 and a wall part 113*b* surrounding a lower half part of the waste toner taking-up unit 232.

The cleaning blade 105 is attached to an upper end of the side wall 111 via a holder 106, and the thin film seal member 108 is attached to an upper end of the side wall 112 via a holder 109. The holder 106 is formed of a metal plate having a belt-like shape and is arranged such that one edge thereof is attached to the upper end of the side wall 111 and, in the present embodiment, a tip of the other edge thereof protrudes toward a downstream side in the traveling direction of the intermediate transfer belt 30, and, by holding the cleaning blade 105, prevents the cleaning blade 105 from being deformed. Further, the holder 106 is deformed into an "L" shape by sheet metal processing, and strength thereof is increased.

Further, the cleaning blade 105 has a belt-like shape and is formed of an elastic rubber material such as an urethane rubber and is arranged such that one edge thereof is attached to the edge of the holder 106 and, in the present embodiment, a tip of the other edge thereof protrudes toward an upstream side in the traveling direction of the intermediate transfer belt 30 and is in contact with the intermediate transfer belt 30.

Further, the thin film seal member 108 has a belt-like shape and is formed of an elastic resin film and is arranged such that one edge thereof is attached to an edge of the holder 109 and, in the present embodiment, a tip of the other edge thereof protrudes toward a downstream side in the traveling direction of the intermediate transfer belt 30 and is in contact with the intermediate transfer belt 30. The thin film seal member 108 is arranged such that the tip thereof faces a downstream side in the traveling direction of the intermediate transfer belt 30, and thus, allows the transfer residual toner on the intermediate transfer belt 30 to slip through.

A sealed space Sp is formed by the scraped toner accommodation part 110, the intermediate transfer belt 30, the cleaning blade 105, and the thin film seal member 108. Seal members 122, 123 that are each formed of a material such as a sponge and seal the sealed space Sp and prevent the transfer residual toner scraped off by the cleaning blade 105 from leaking to the outside of the sealed space Sp are respectively provided between the upper end of the side wall 111 and the holder 106 and between the upper end of the side wall 112 and the holder 109.

However, after a color toner image on the intermediate transfer belt 30 has been transferred to the sheet P, when the amount of the toner remaining on the intermediate transfer belt 30 is small, the cleaning blade 105 and the intermediate transfer belt 30 are worn away and friction between the cleaning blade 105 and the intermediate transfer belt 30 is increased. As a result, curling, chipping, or the like occurs to the tip of the cleaning blade 105, and the transfer residual toner on the intermediate transfer belt 30 cannot be sufficiently scraped off and removed.

Therefore, in the present embodiment, as described above, the waste toner taking-up unit 232 is arranged and supplies the waste toner as a lubricant to the contact portion between the cleaning blade 105 and the intermediate transfer belt 30, and thereby, occurrence of curling, chipping or the like to the tip of the cleaning blade 105 is suppressed.

Therefore, the waste toner taking-up unit 232 includes a shaft sh1, and a brush Br1 arranged in a longitudinal direction of the shaft sh1 at a predetermined place in a circumferential direction of the shaft sh1. The brush Br1 is formed of a hair bundle group including a plurality of brush hair bundles, and the hair bundles are respectively implanted at a plurality of places along the longitudinal direction of the shaft sh1.

When the shaft sh1 is rotated, a tip of the brush Br1 comes into contact with opposing places in the sealed space Sp, that is, the spiral 231, the bottom wall 113 of the scraped toner accommodation part 110 and the intermediate transfer belt 30, and is bent. When the tip of the brush Br1 is away from the intermediate transfer belt 30 and is not opposing the intermediate transfer belt 30, the tip of the brush Br1 is released from the intermediate transfer belt 30 and returns to its original state due to elasticity of the hair bundles.

Along with this, the waste toner in the scraped toner accommodation part 110 is taken up away from the hair bundles and is supplied as a lubricant to the contact portion between the cleaning blade 105 and the intermediate transfer belt 30.

Therefore, a length of the brush Br1 is set such that the fore end of the brush Br1 is sufficiently in contact with the spiral 231, the bottom wall 113 of the scraped toner accommodation part 110 and the intermediate transfer belt 30 and is bent. The brush Br1 overlaps with the places of the spiral 231, the bottom wall 113 of the scraped toner accommodation part 110 and the intermediate transfer belt 30. "R" in FIG. 1 denotes a brush tip diameter representing a distance from the center of the shaft sh1 to the tip of the brush Br1.

Next, an operation of the cleaning device 100 is described.

Figure 6:
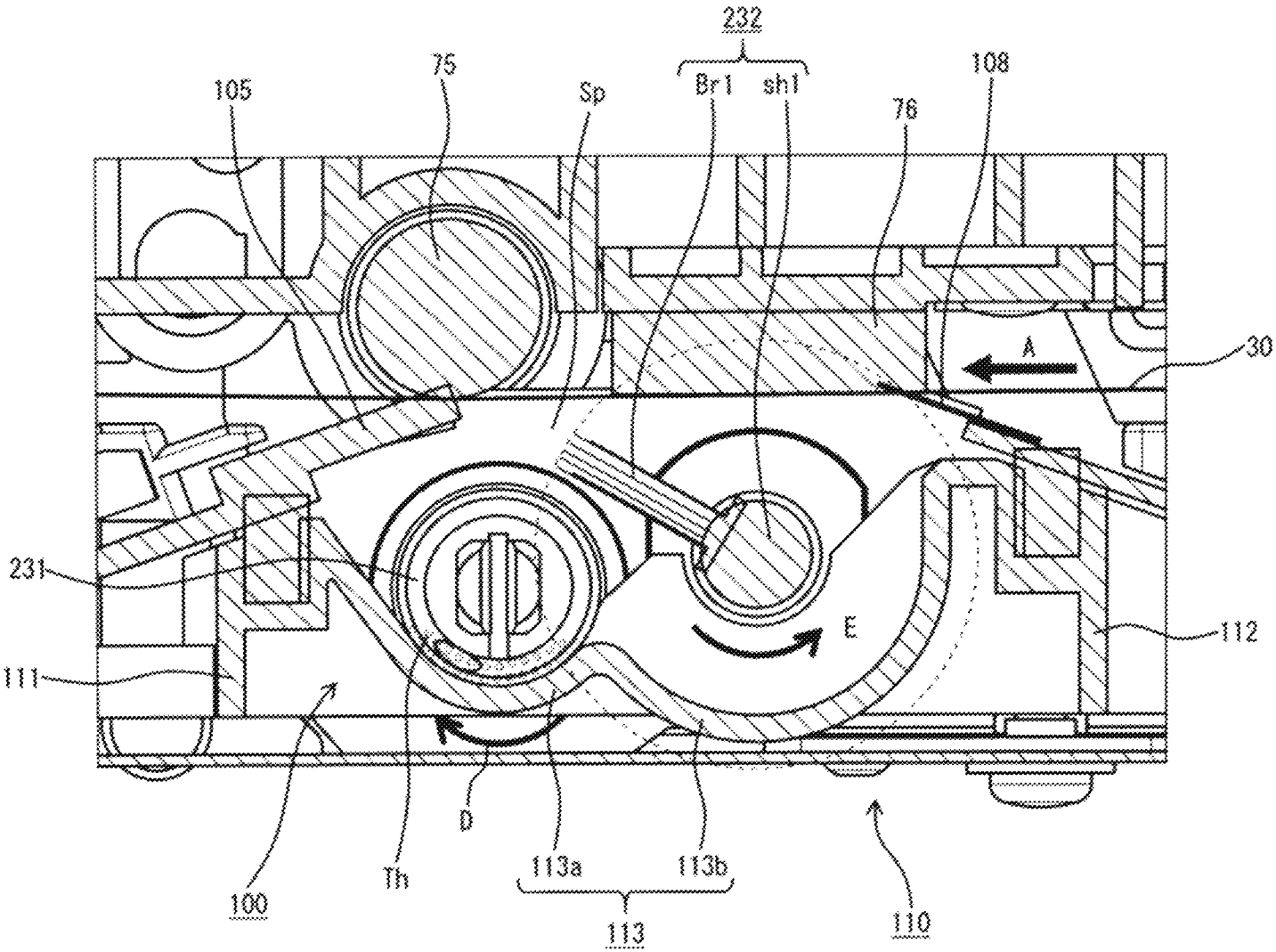
FIG. 6 is a first diagram for describing an operation of the cleaning device in the first embodiment of the present invention.
Figure 7:
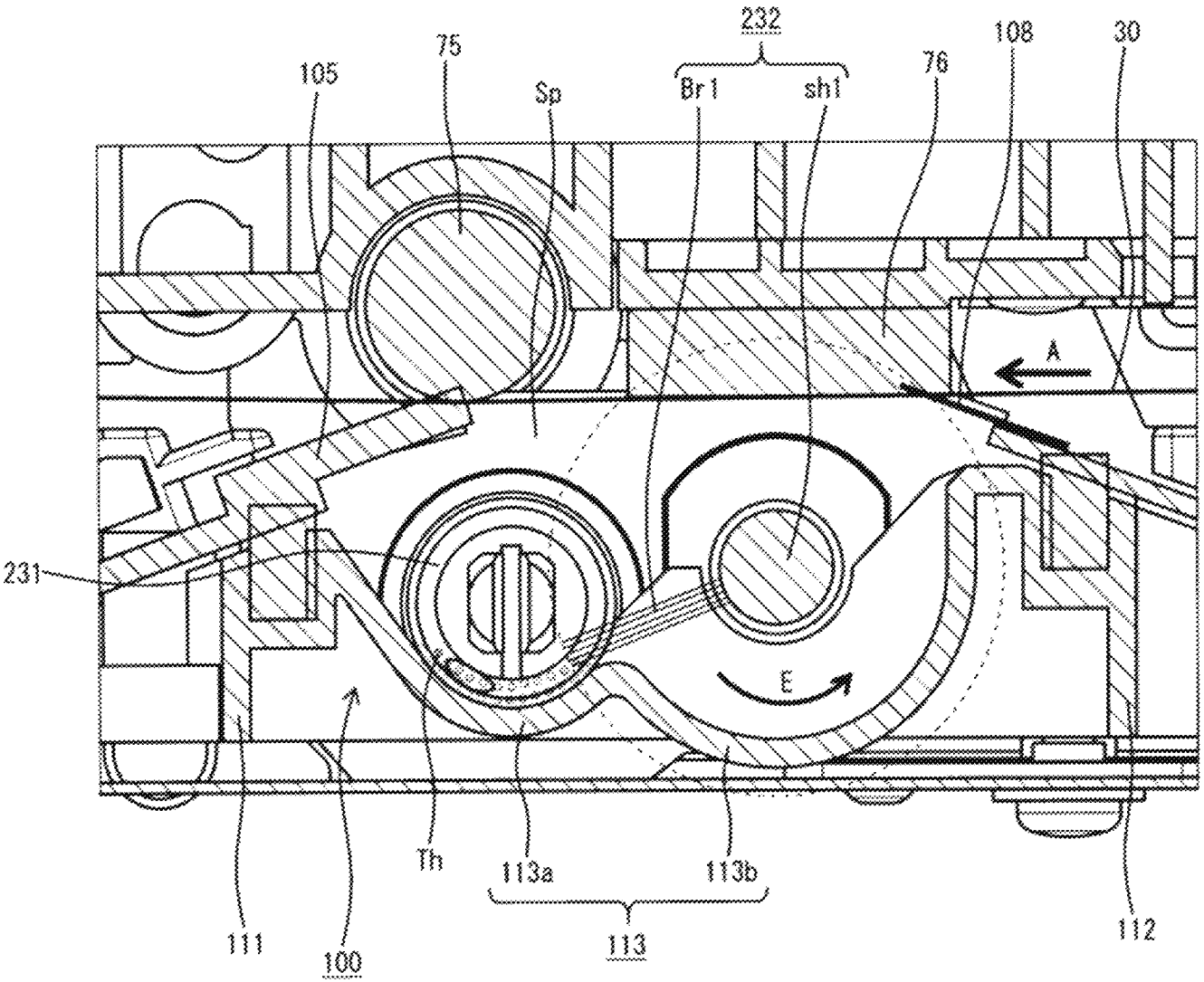
FIG. 7 is a second diagram for describing the operation of the cleaning device in the first embodiment of the present invention.
Figure 8:
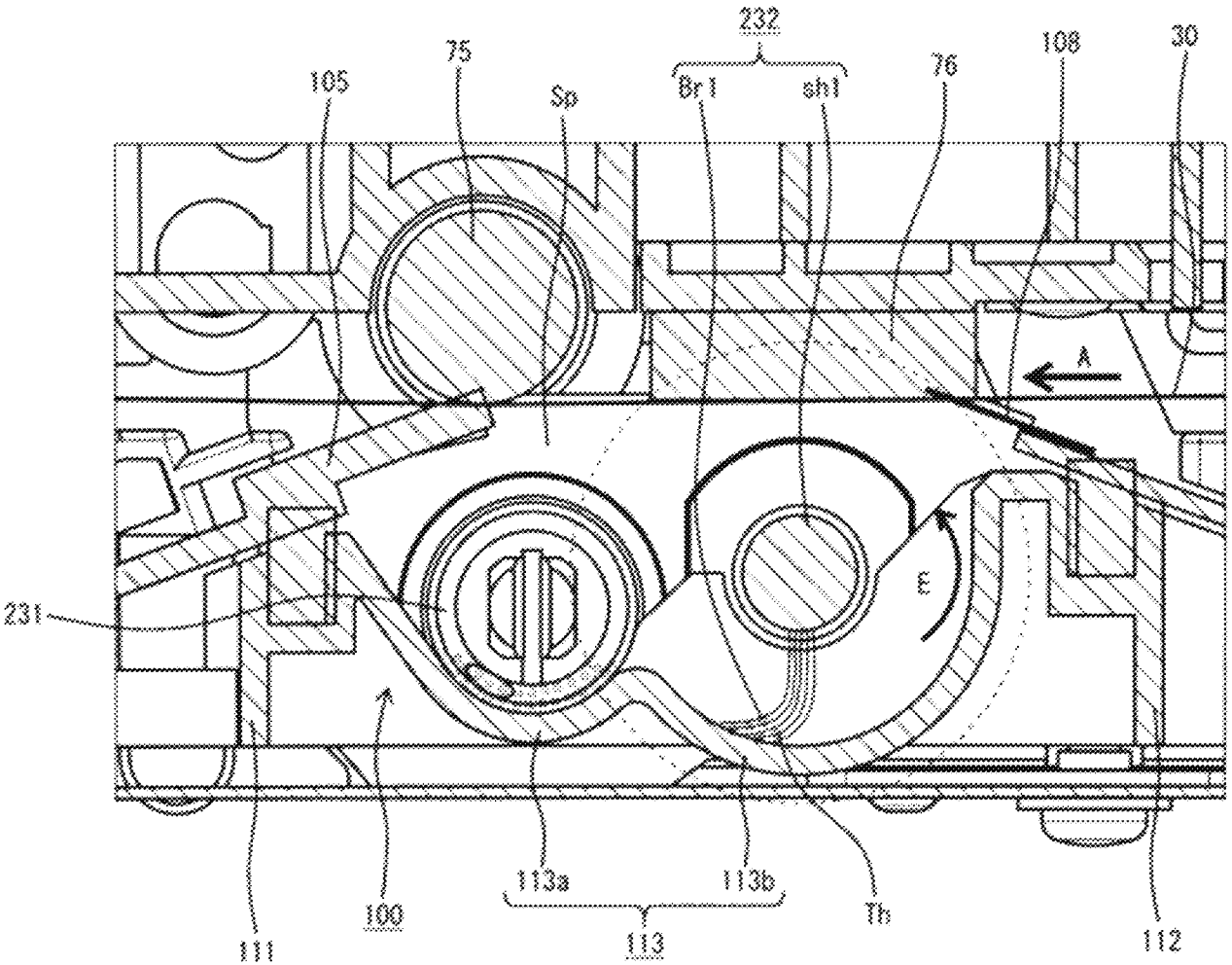
FIG. 8 is a third diagram for describing the operation of the cleaning device in the first embodiment of the present invention.
Figure 9:
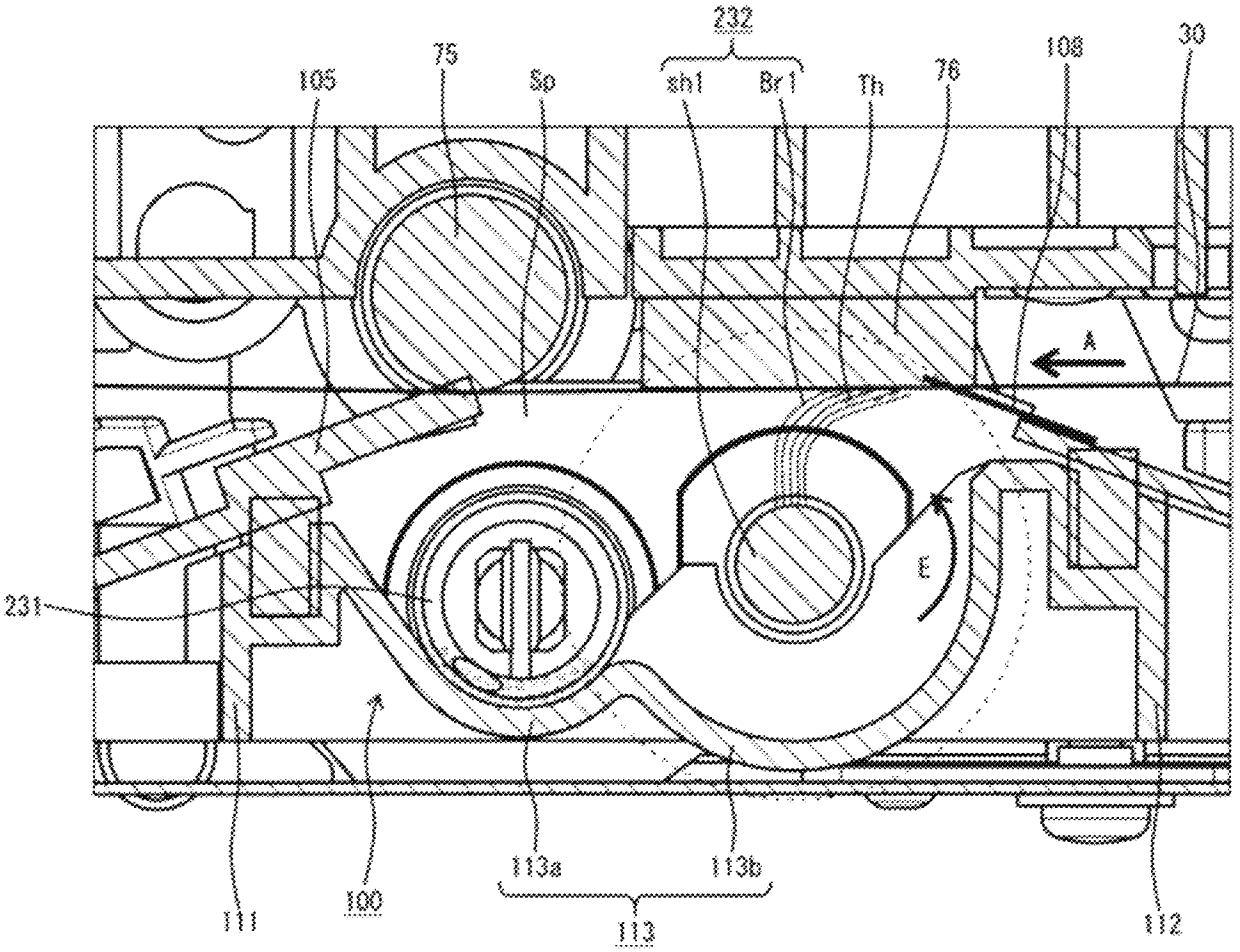
FIG. 9 is a fourth diagram for describing the operation of the cleaning device in the first embodiment of the present invention.
Figure 10:
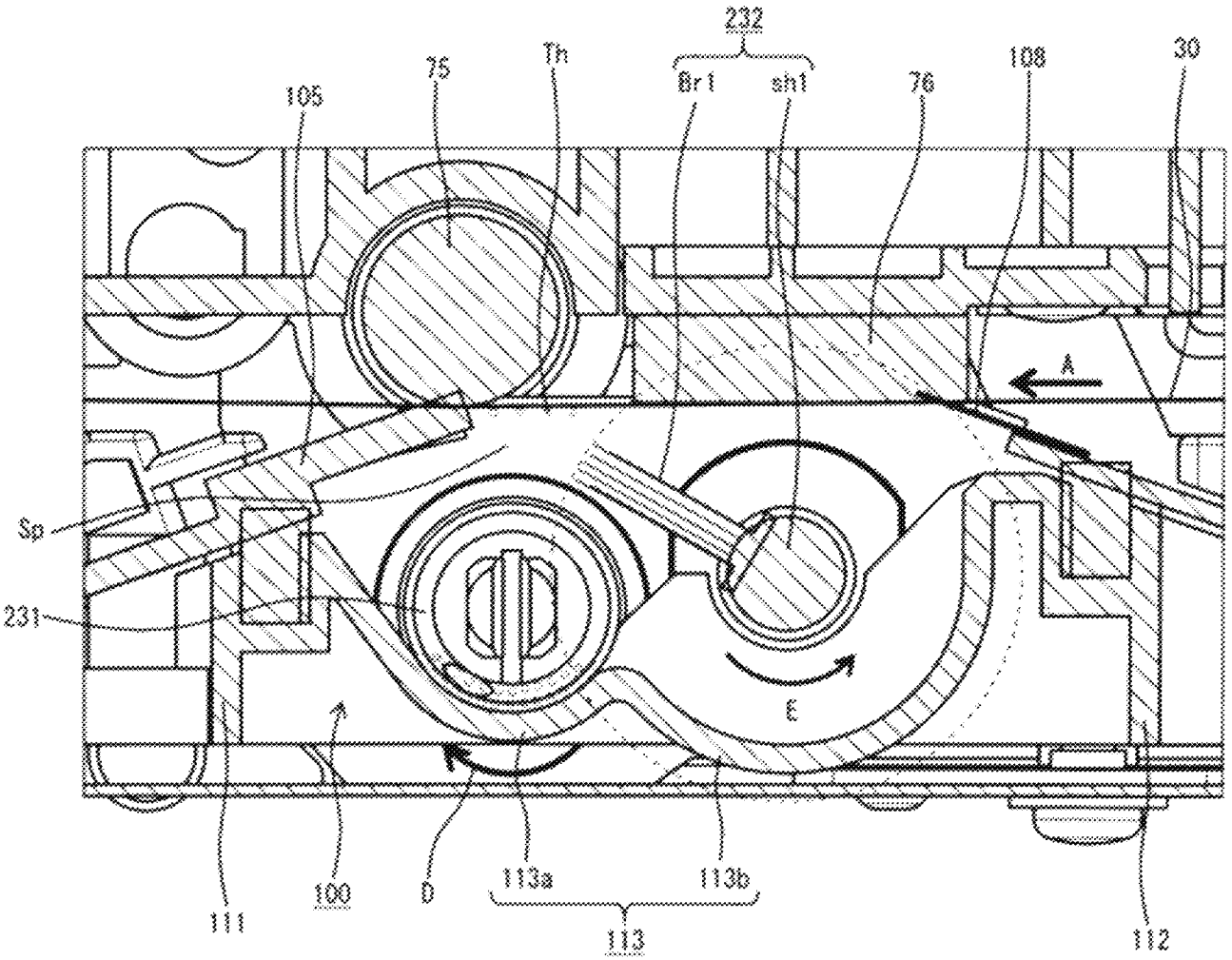
FIG. 10 is a fifth diagram for describing the operation of the cleaning device in the first embodiment of the present invention.

FIG. 6 is a first diagram for describing the operation of the cleaning device in the first embodiment of the present invention. FIG. 7 is a second diagram for describing the operation of the cleaning device in the first embodiment of the present invention. FIG. 8 is a third diagram for describing the operation of the cleaning device in the first embodiment of the present invention. FIG. 9 is a fourth diagram for describing the operation of the cleaning device in the first embodiment of the present invention. FIG. 10 is a fifth diagram for describing the operation of the cleaning device in the first embodiment of the present invention.

In the drawings, "30" denotes the intermediate transfer belt; "75" denotes the support roller; "76" denotes the support sponge; "100" denotes the cleaning device; "105" denotes the cleaning blade; "108" denotes the thin film seal member; "110" denotes the scraped toner accommodation part; "111" and "112" denote the side walls; "113" denotes the bottom wall; "113*a*" and "113*b*" denote the wall parts; "Sp" denotes the sealed space; "231" denotes the spiral; "232" denotes the waste toner taking-up unit; "sh1" denotes the shaft; "Br1" denotes the brush; and "Th" denotes the waste toner.

Since the spiral 231 is connected to the waste toner carrying motor via the gear gr1 (FIG. 5), when the printer 10 (FIG. 2) is powered on, an initial operation is started and the spiral 231 is rotated in an arrow D direction, and the rotation is transmitted to the gear gr2 and the waste toner taking-up unit 232 is rotated in an arrow E direction. As a result, the waste toner Th is carried on the bottom wall 113 by the spiral 231.

As in contact with FIG. 6, when the hair bundles of the brush Br1 are positioned above the spiral 231 in the sealed space Sp, the tip of the brush Br1 extends linearly and, along with the rotation of the waste toner taking-up unit 232, passes through the spiral 231. As illustrated in FIG. 7, when the tip of the brush Br1 reaches the wall part 113*a* of the bottom wall 113, the tip of the brush Br1 is in contact with the waste toner Th carried on the bottom wall 113 and holds the waste toner Th in the hair bundles.

Subsequently, as illustrated in FIG. 8, the tip of the brush Br1 bends against the elasticity of the hair bundles and slides on the wall part 113*b*. After that, as illustrated in FIG. 9, the tip of the brush Br1 comes into contact with the intermediate transfer belt 30. In this case, a part of the waste toner Th held in the hair bundles adheres to the intermediate transfer belt 30, and, as illustrated in FIG. 10, along with the traveling of the intermediate transfer belt 30, is supplied as a lubricant to the contact portion between the cleaning blade 105 and the intermediate transfer belt 30.

Then, when the tip of the brush Br1 moves away from the intermediate transfer belt 30 and is no longer opposing the intermediate transfer belt 30 after being largely bent in contact with the intermediate transfer belt 30, the tip of the brush Br1 is released from the intermediate transfer belt 30 and returns to its original state due to the elasticity of the hair bundles.

In this way, in the present embodiment, the waste toner taking-up unit 232 having the shaft sh1 and the brush Br1 is rotatably arranged adjacent to the spiral 231 in the scraped toner accommodation part 110, and the waste toner Th is taken up along with the rotation of the waste toner taking-up unit 232 and is supplied as a lubricant to the contact portion between the cleaning blade 105 and the intermediate transfer belt 30. Therefore, an increase in the friction between the cleaning blade 105 and the intermediate transfer belt 30 can be suppressed, and occurrence of curling, chipping or the like to the cleaning blade 105 can be prevented. Therefore, the transfer residual toner can be sufficiently removed.

Further, since the spiral 231 is arranged independently of the waste toner taking-up unit 232, even when the brush Br1 comes into contact with the bottom wall 113 of the scraped toner accommodation part 110, the ability of the spiral 231 to carry the waste toner Th is not lowered. Therefore, the spiral 231 does not cause clogging, and thus, the waste toner Th can be reliably carried.

Further, since the brush Br1 overlaps with the places of the spiral 231, the bottom wall 113 of the scraped toner accommodation part 110 and the intermediate transfer belt 30, a part of the waste toner Th carried by the spiral 231 can adhere to the intermediate transfer belt 30, and the waste toner Th can be efficiently supplied to the contact portion between the cleaning blade 105 and the intermediate transfer belt 30.

In the present embodiment, the brush Br1 is arranged in the longitudinal direction of the shaft sh1 at a predetermined place in the circumferential direction of the shaft sh1. However, it is also possible that the brush is arranged in the longitudinal direction of the shaft sh1 at a plurality of places in the circumferential direction of the shaft sh1, or the brush is arranged over a predetermined distance in the longitudinal direction of the shaft sh1 at a plurality of places in the circumferential direction of the shaft sh1. In those embodiments above, a tip of the brush Br1 is configured to extend in the radial direction of the shaft sh1, which is seen from the axial direction of the shaft sh1.

In the present embodiment, along with the rotation of the waste toner taking-up unit 232, the tip of the brush Br1 temporarily comes into contact with the intermediate transfer belt 30 and bends. Therefore, depending on whether or not the tip of the brush Br1 is in contact with the intermediate transfer belt 30, a load applied to the intermediate transfer belt 30 varies, and a traveling speed of the intermediate transfer belt 30 varies. In this case, disturbance occurs in a color toner image transferred from the photosensitive drums 31 to the intermediate transfer belt 30, and image quality of a color image formed on the sheet P is decreased.

Therefore, a second embodiment of the present invention is described below in which variation in the traveling speed of the intermediate transfer belt 30 associated with the rotation of the waste toner taking-up unit 232 is prevented. A component having a same structure as in the first embodiment is indicated using the same reference numeral symbol and, for an effect of the invention due to having the same structure, the effect of the first embodiment is incorporated.

Figure 11:
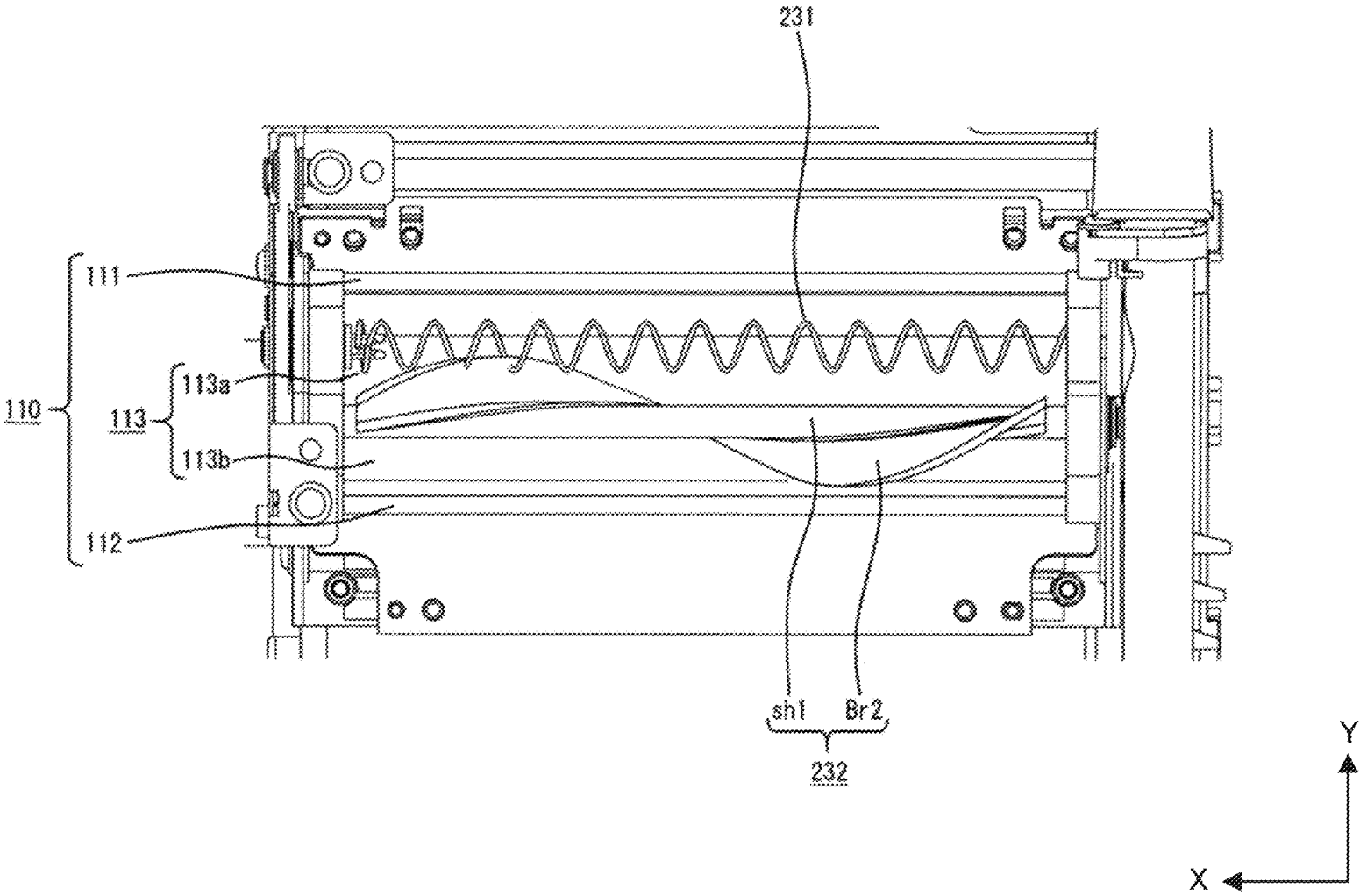
FIG. 11 is a cross-sectional view of a main part of a cleaning device in a second embodiment of the present invention.

FIG. 11 is a cross-sectional view of a main part of a cleaning device in the second embodiment of the present invention.

In FIG. 11, "110" denotes a scraped toner accommodation part as a waste developer accommodation chamber; "111" and "112" respectively denote side walls as a first wall and a second wall; "113" denotes a bottom wall as a third wall; "113*a*" and "113*b*" respectively denote wall parts; "231" denotes a spiral as a waste developer carrying member; "232" denotes a waste toner taking-up unit as a waste developer taking-up member; "sh1" denotes a shaft; and "Br2" denotes a brush.

In the present embodiment, the brush Br2 is attached in a spiral shape to the shaft sh1, and a winding pitch number of the brush Br2 is set to an integer multiple with respect to the width of the intermediate transfer belt 30 (FIG. 1) as a belt member, that is, N times (1 times in the present embodiment). Putting it another way, when it assumes that the winding pitch means a distance in an axial direction X of the shaft, which is shown in FIG. 11, in which the brush Br2 turns one around, the winding pitch number means how many times the brush Br2 turns around. The number is preferred to be an integer. FIG. 11 shows a brush of which the winding pitch number is one.

Therefore, along with the rotation of the waste toner taking-up unit 232, the brush Br2 is always in contact with the intermediate transfer belt 30 at N points (at 1 point in the present embodiment). Therefore, variation in the load applied to the intermediate transfer belt 30 is eliminated, and the traveling speed of the intermediate transfer belt 30 can be kept constant. As a result, disturbance does not occur to toner images as developer images transferred from the photosensitive drums 31 (FIG. 2) as image carriers to the intermediate transfer belt 30, and image quality of a color image formed on the sheet P as a medium can be improved.

In order to maintain the load consistent, the shaft sh1 of the brush may be arranged in the width direction of the intermediate transfer belt 30 with a constant distance. Further, a brush length, which is determined from the shaft sh1 to the tip of the brush in the radial direction of the shaft, may be consistent around the shaft sh1.

Further, since the brush Br2 is attached in a spiral shape to the shaft sh1, along with the rotation of the waste toner taking-up unit 232, a load in an axial direction (X in FIG. 11) is applied to the intermediate transfer belt 30 due to a frictional force occurring between the brush Br2 and the intermediate transfer belt 30.

Therefore, in the present embodiment, the waste toner taking-up unit 232 is rotated in a forward direction with respect to a carrying direction of the intermediate transfer belt 30 and the load in the axial direction allied to the intermediate transfer belt 30 is reduced. As a result, meandering of the intermediate transfer belt 30 can be suppressed.

In the above embodiments, the spiral 231 formed of a coil spring having a spiral shape is used as a waste developer carrying member. However, as a waste developer carrying member, an auger formed by forming a spiral groove around a rod having a cylindrical shape can be used.

Further, in the above embodiments, the cleaning device 100 for removing toner on the intermediate transfer belt 30 in the printer 10 of an intermediate transfer type using the intermediate transfer belt 30 is described. However, the present invention can also be applied to a cleaning device for removing toner on a sheet carrying belt as a belt member carrying a sheet P in a printer of a direct transfer type that does not use the intermediate transfer belt 30.

Further, in the above embodiments, the color printer 10 is described. However, the present invention can also be applied to image forming apparatuses such as a copying machine, an LED printer, a laser beam printer, a facsimile, and a multifunction machine.

Further, the present invention is not limited to the above embodiments. Based on the spirit of the present invention, various modifications are possible, which are not to be excluded from the scope of the present invention.

Figure 12:
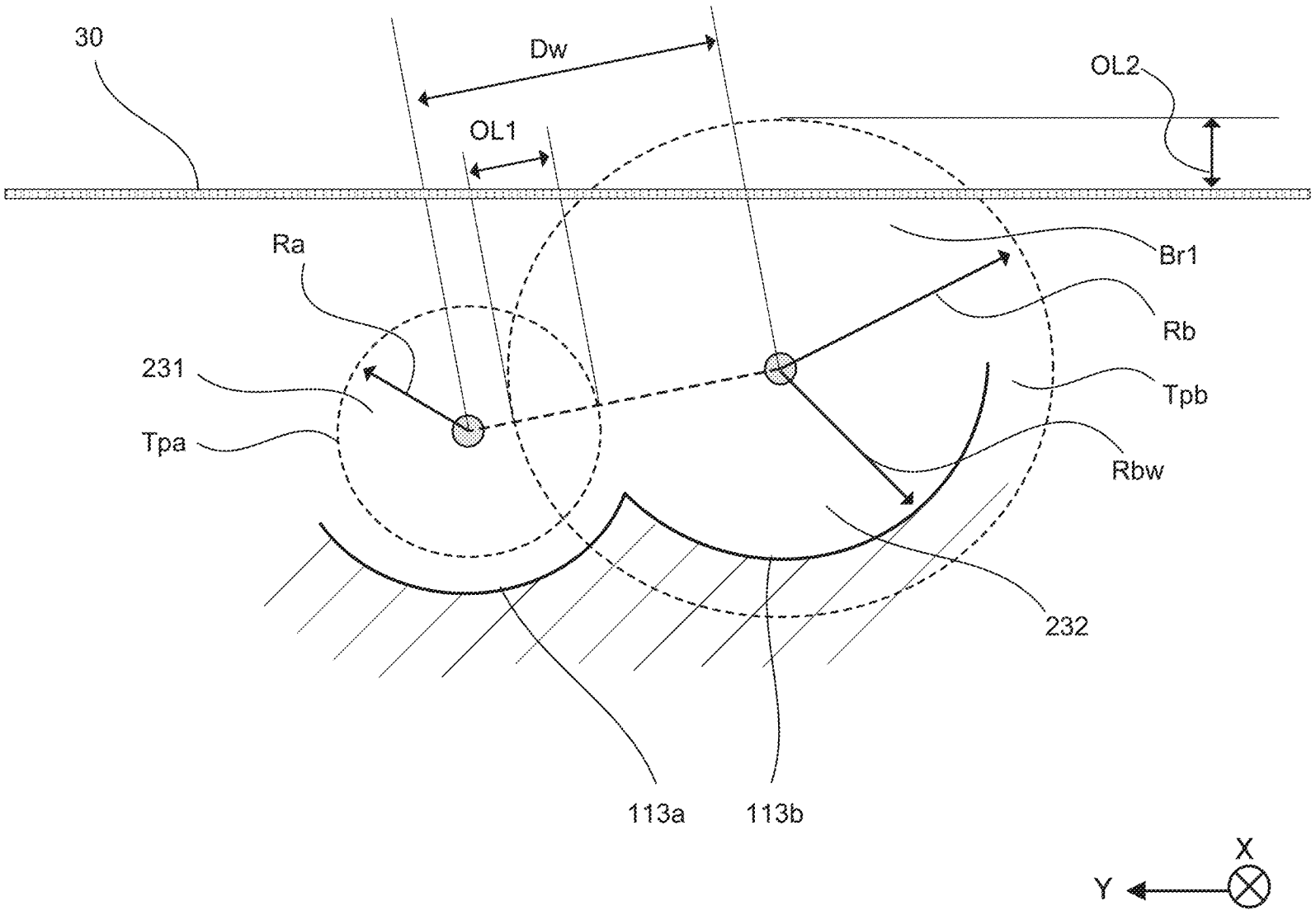
FIG. 12 shows a relationship between spiral 231 and unit 232, seen from the side view.

The present invention is realized in various specifications. FIG. 12 shows a relationship between spiral 231 and unit 232. Seen from side view (X), the rotational circle drawn by tip of the spiral is denoted with Tpa. The rotational circle drawn by tip of unit 232 is denoted with Tpb. The radius of Tpa is with Ra, the radius of Tpb is with Rb, the distance up to the inner wall of 112*b* is with Rbw. Further, the length of the unit 232 above the sheet 30 is with OL2. The distance between two rotation axes is Dw. The overlap distance between the spiral 231 and the unit 232 is with OL1.

Based on one embodiment, the invention may satisfy one or more following conditions:

OL1/Dw: 20% to 50%
OL1/Rb: 30% to 50%
OL1/Ra: 45% to 75%
OL2/Rb: 15% to 35%
Rbw/Rb: 70% to 85%

What is claimed is:

1. A belt unit, comprising:

(a) a belt member that is stretched by a plurality of rollers in a manner freely travelable;

(b) a cleaning member that is arranged with a tip thereof being in contact with the belt member and scrapes off a developer being attached and carried on the belt member as the belt member travels;

(c) a waste developer accommodation chamber that accommodates the developer as a waste developer scraped off by the cleaning member;

(d) a waste developer carrying member that is rotatably arranged in the waste developer accommodation chamber and carries the waste developer accommodated in the waste developer accommodation chamber in correspondence with a rotation thereof, and (e) a waste developer taking-up member that is composed with a shaft and a brush attached to the shaft such that the waste developer taking-up member makes a rotation around the shaft, and is arranged adjacent to the waste developer carrying member in the waste developer accommodation chamber, wherein in correspondence with the rotation of the waste developer taking-up member, the waste developer taking-up member is in physical contact with the waste developer carrying member, takes up the waste developer from the waste developer carrying member, and supplies the waste developer to a contact portion between the cleaning member and the belt member.

2. The belt unit according to claim 1, wherein the brush overlaps with the waste developer carrying member.

3. The belt unit according to claim 1, wherein the brush overlaps with a bottom wall of the waste developer accommodation chamber.

4. The belt unit according to claim 3, wherein the bottom wall of the waste developer accommodation chamber includes wall parts that respectively surround a lower half part of the waste developer carrying member and a lower half part of the waste developer taking-up member, and these lower half parts are determined with respect to a vertical direction, which is parallel to the direction of gravity.

5. The belt unit according to claim 1, wherein the brush overlaps with the belt member.

6. The belt unit according to claim 1, wherein a support member is arranged on a back side of the belt member, which is opposite to the waste developer carrying member, and applies a reaction force to the belt member such that the belt member does not deform.

7. The belt unit according to claim 1, wherein the brush is attached in a spiral shape around the shaft.

8. An image forming apparatus, comprising:

(a) the belt unit according to claim 1; and (b) an image forming unit that has an image carrier and forms a developer image on the image carrier, wherein (c) the developer image is transferred to a medium carried along with traveling of the belt member.

9. An image forming apparatus, comprising:

(a) the belt unit according to claim 1; and (b) an image forming unit that has an image carrier and forms a developer image on the image carrier, wherein (c) the developer image is transferred to the belt member.

10. The belt unit according to claim 1, wherein the waste developer taking-up member and the waste developer carrying member satisfy following (1) and (2):

$$OL1=Rb-Ra \quad (1)$$

$$OL1>0 \quad (2)$$

where Rb is a rotation radius of the waste developer taking-up member, and

Ra is a rotation radius of the waste developer carrying member.

11. The belt unit according to claim 10, wherein

Rb and OL1 satisfy following (3):

$$0.3 \leq OL1/Rb \leq 0.5 \quad (3).$$

12. A belt unit, comprising:

(a) a belt member that is stretched by a plurality of rollers in a manner freely travelable;

(b) a cleaning member that is arranged with a tip thereof being in contact with the belt member and scrapes off a developer being attached and carried on the belt member as the belt member travels;

(c) a waste developer accommodation chamber that accommodates the developer as a waste developer scraped off by the cleaning member;

(d) a waste developer caring member that is rotatably arranged in the waste developer accommodation chamber and carries the waste developer accommodated in the waste developer accommodation chamber in correspondence with a rotation thereof; and (e) a waste developer taking-up member that is rotatably arranged adjacent to the waste developer carrying member in the waste developer accommodation chamber, and takes up the waste developer in correspondence with a rotation thereof and supplies the waste developer to a contact portion between the cleaning member and the belt member, wherein (f) the waste developer taking-up member is composed with a shaft and a brush attached to the shaft, and a winding pitch number of the brush is set to an integer multiple with respect to a width of the belt member.

13. The belt unit according to claim 12, wherein the winding pitch number of the brush is set to be one with respect to the width of the belt member.

* * * * *